US012704279B2

(12) United States Patent
Clemenzi et al.

(10) Patent No.: US 12,704,279 B2
(45) Date of Patent: Aug. 11, 2026

(54) MODULAR ENCAPSULATED HEAT PUMPS

(71) Applicants: Richard A Clemenzi, Asheville, NC (US); Judith A Clemenzi, Asheville, NC (US)

(72) Inventors: Richard A Clemenzi, Asheville, NC (US); Judith A Clemenzi, Asheville, NC (US)

( * ) Notice: Subject to any disclaimer, the term of this patent is extended or adjusted under 35 U.S.C. 154(b) by 426 days.

(21) Appl. No.: 18/026,348

(22) PCT Filed: Sep. 15, 2021

(86) PCT No.: PCT/US2021/050560
§ 371 (c)(1),
(2) Date: Mar. 15, 2023

(87) PCT Pub. No.: WO2022/060913
PCT Pub. Date: Mar. 24, 2022

(65) Prior Publication Data

US 2023/0358425 A1 Nov. 9, 2023

Related U.S. Application Data

(60) Provisional application No. 63/141,959, filed on Jan. 26, 2021, provisional application No. 63/137,437,
(Continued)

(51) Int. Cl.
*F24F 11/36* (2018.01)
*F24F 11/89* (2018.01)
(Continued)

(52) U.S. Cl.
CPC ..... *F24F 11/36* (2018.01); *F24F 11/89* (2018.01); *F24F 12/003* (2013.01); *F25B 41/26* (2021.01);
(Continued)

(58) Field of Classification Search
CPC ..... F24F 11/89; F24F 11/36; F24F 12/003; F24F 2221/36; F25B 41/26; F25B 2400/21; F25B 2345/006; F25B 45/00
See application file for complete search history.

(56) References Cited

U.S. PATENT DOCUMENTS 4,539,817 A * 9/1985 Staggs ..... F25B 45/00 62/149
5,309,985 A * 5/1994 Erickson ..... F25B 17/08 62/480
(Continued)

FOREIGN PATENT DOCUMENTS

CN 103089480 A * 5/2013
CN 103743142 A * 4/2014

*Primary Examiner* — Frantz F Jules
*Assistant Examiner* — Martha Tadesse

(57) ABSTRACT

A new thermal system utilizing removable heat pump modules to decrease servicing time and complexity, increase the range of refrigerants safely usable, increase the efficiency of many thermal systems, and serve new industrial thermal needs. Safe use of potentially toxic and flammable refrigerants is enabled by enclosing the heat pump modules within a hermetic enclosure with multiple overpressure safeties employed. The tool necessary for servicing these thermal systems without any refrigerant leakage is included.

22 Claims, 11 Drawing Sheets

Related U.S. Application Data filed on Jan. 14, 2021, provisional application No. 63/078,411, filed on Sep. 15, 2020.

(51) Int. Cl.
*F24F 12/00* (2006.01)
*F25B 41/26* (2021.01)

(52) U.S. Cl.
CPC ..... *F24F 2221/36* (2013.01); *F25B 2400/21* (2013.01)

(56) References Cited

U.S. PATENT DOCUMENTS

| | | | | |
|---|---|---|---|---|
| 6,266,971 | B1 * | 7/2001 | Schroder | B60H 1/00585 62/77 |
| 10,429,105 | B1 * | 10/2019 | Kariya | F25B 29/003 |
| 2018/0363969 | A1 * | 12/2018 | Jacobi | F25B 13/00 |

* cited by examiner

MODULAR ENCAPSULATED HEAT PUMPS

CROSS-REFERENCE TO RELATED APPLICATIONS

Priority is claimed from the following three U.S. provisional patent applications: Ser. No. 63/078,411 filed Sep. 15, 2020; Ser. No. 63/137,437, filed Jan. 14, 2021; and Ser. No. 63/141,959, filed Jan. 26, 2021.

BACKGROUND OF THE INVENTION

The invention relates to the field of vapor cycle refrigeration equipment which we herein term "heat pumps", including use for all temperature ranges of heating and cooling, and servicing of the same.

SUMMARY OF THE INVENTION

In one aspect, apparatus for refrigerant leak-free "heat pump" thermal energy manipulation is provided, including necessary tools for leak-free support. The apparatus includes swappable heat pump modules and the modular heat pump systems which utilize said heat pump modules.

In another aspect, apparatus is provided for containment of a refrigerant system such that no single point failure could enable leakage of the refrigerant including the tool needed to service the apparatus without refrigerant leakage.

In another aspect, apparatus is provided for simplifying refrigerant system servicing including modularized heat pump modules which can be easily swapped out of an operational thermal system without leakage or the necessity of powering down and evacuating all refrigerant from the system, and which modules can then be depot serviced if desired reducing the level of technician skill required in refrigerant system servicing.

In another aspect, apparatus is provided for full electrification of many industrial thermal processes including heating, drying, cooking, and even some smelting. Said apparatus includes multi-staged application of the modularized heat pump modules such that thermal energy is both reclaimed and reapplied in a highly efficient manner, and such that each stage can be individually charged with a different refrigerant to optimize the thermal processes involved.

In another aspect, apparatus is provided for servicing the same leak-free refrigerant systems such that zero refrigerant leakage occurs even when connecting and disconnecting hoses during diagnosis, refrigerant charging, and refrigerant reclamation.

DETAILED DESCRIPTION

Figure 1:
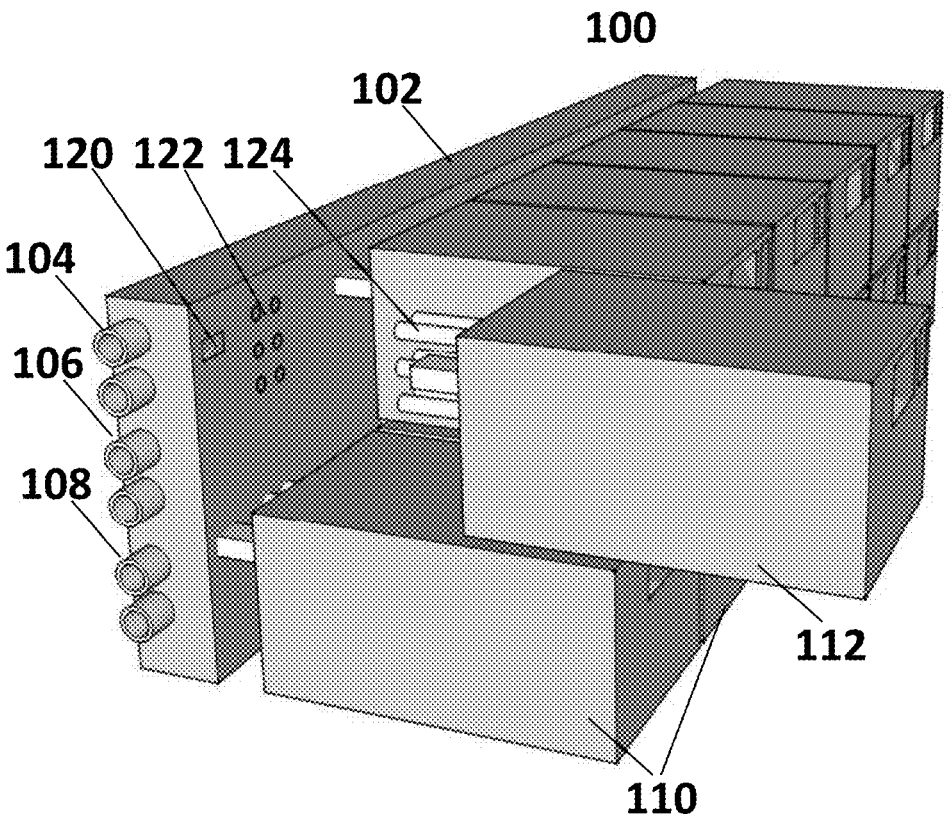
FIG. 1 shows a view of one embodiment of a thermal system apparatus employing removable heat pump modules in volume to replace a large heat pump system.

This invention advances the vapor cycle refrigeration, a.k.a. "Heat Pump", field in multiple ways, including by simplifying field service via swappable Heat Pump Modules, enabling more efficient heat pump systems by allowing use of differing refrigerants in the many different Heat Pump Modules within the same Thermal System, enabling the broad use of more efficient refrigerants even when potentially toxic or flammable by fully encapsulating the refrigerant aspects of the heat pump modules and any involved external refrigerant heat exchangers, by specifically providing for industrial thermal processes involving drying and direct application of thermal energy, and with the necessary refrigerant tool for leak-free refrigerant system servicing. This innovation brings new levels of efficiency to some refrigerant systems, enables some new use of refrigerant systems for especially higher heat applications, and brings new levels of cost-effectiveness to virtually all refrigerant system servicing. We use the term "heat pump" herein to represent any vapor cycle refrigeration system meant to "move", hence "pump", heat from one location to another. This includes everything from refrigerators and freezers to building heating and cooling systems to all hot water production to industrial thermal processes. These "heat pumps" always include a compressor, refrigerant "dryer", refrigerant flow regulation valve (e.g., TXV), various piping and service ports, and both a cold and hot heat exchanger either or both of which may be local to or remote from the balance of the heat pump.

Another important aspect of this innovation is an Encapsulated Heat Pump Module. With or without the "encapsulation", the innovation will lower life cycle cost, increase overall thermal system reliability, and both thermal system raises uptime and lower the skill level required for heat pump technicians via the hot-swappable module approach. The added "encapsulation" and complete attention to leak-free refrigeration brings whole new application opportunities to heat pumps providing both new levels of process efficiency and helping drive rapid process electrification for Climate Action. This is especially true for high temperature process electrification including for many processes now only served by fossil fuel combustion. It is the stated goal of this encapsulated Heat Pump Module and Thermal System approach to eliminate all fossil fuel use from thermal processes through at least 1100° F./550° C. for which we have already identified candidate refrigerant substances. These Heat Pump Modules come in many forms depending on the specific application involved, but always include the core refrigeration elements of the compressor and associated apparatus. Sometimes the heat exchangers will be built into the Heat Pump Module and sometimes they will be remote as needed for the specific application.

Another important aspect of this innovation is that the Encapsulated Heat Pump Modules can provide for self-recovery of any leaked refrigerant within the containment encapsulation. This is an issue when there are any non-hard seals such as shaft seals which may micro-leak and slowly build up some refrigerant in the enclosed area. Provided the encapsulated area is maintained atmospheric free or at vacuum, the addition of selectively operable valves on both the low pressure side of the compressor and between that low pressure side and what is usually connected refrigerant piping allows brief operation of the compressor to pull the leaked refrigerant out of the enclosure compressing it back into the contained refrigerant system and restoring at least very low or no pressure within the enclosure.

At the Thermal System level, multiple Heat Pump Modules are employed, sometimes in new ways which increase overall Thermal System efficiency, but which always improve serviceability and can thus reduce downtime. This modular approach also makes these systems fully scalable to meet any capacity need. The use of Encapsulated Heat Pump Modules which allow widespread use of toxic and flammable refrigerants further significantly raise the thermal range available for the Thermal Systems. With this modular approach to Thermal Systems, one can use as many different refrigerants as there are Heat Pump Modules in the system to "fine tune" the thermal efficiency of each step. Each refrigerant has a different pressure-temperature relationship between its vapor and liquid phases, and thus each refrigerant is most efficient when utilized only within certain rather tight thermal ranges. Thus where previously one might employ a single refrigerant system to deliver a 40 degree difference between its input and output, with the Heat Pump Modules we can break this down into 4 separate "thermal steps" each of which could be as much as twice as efficient resulting is the doubling of the overall system efficiency. Even further, combining this 'small thermal step' approach to heat pump application and further making extra effort to thermally encapsulate an industrial process, one can now capture and recycle nearly all the energy that is already "in the process", slightly boost it via the heat pumps including the heat from the electricity powering the heat pump compressor's motor, and re-apply that same energy to the process without any other energy being necessary. Heat Pump systems can be readily designed for very high efficiencies so long as the thermal gain needed is small, thus so long as a thermal process is thermally well encapsulated it will also operate with this approach at a very high efficiency. The goal of this approach is to at least achieve a 5:1 efficiency gain over direct thermal energy application via this "energy recycling" approach, and hopefully to achieve 7:1 efficiency gain or greater.

The result of the modularity, encapsulation, and creative industrial "energy recycling" will be to enable new levels of thermal process electrification not before envisioned. This is a necessary innovation step for Climate Action and thus important to bring to society.

Referring now to the drawings, FIG. 1 shows a view of one embodiment of a thermal system apparatus employing removable Heat Pump Modules in significant volume to replace a large heat pump system, in this case a typical building thermal energy system which delivers energy in water loops. Shown is the Thermal System (100) which includes a "backplane" like structure (102) with the building pipe loops for hot (104) and cold water (106), and further in this case super heater water (108) which is extra hot. The heat Pump Modules (110) are each removable (112) and can be charged individually with different refrigerants if desired. The backplane structure (102) provides one half on the electrical (120) fluid loop connections (122) with the removable modules having the opposite and mating electrical (124, not visible) and fluid loop structures (126). Shown here are pipes for the modules and connectors in the backplane, but the opposite configuration is another possible embodiment and likely better (i.e., protruding pipes from the backplane and "connectors" on the heat pump modules so there is less risk of shipping damage when heat pump modules are shipped for depot service). The same approach applies to any thermal system regardless of the number of heat pump modules involved to gain at least the hot-swappable improved serviceability and reliability benefits, such as for the heat pump core refrigerant elements in a unitary geothermal heat pump which is otherwise extremely difficult to service. Not shown for simplicity are the control system and physical mounting structure which are obvious elements to anyone familiar with heat pump and other refrigerant systems. Also, any smaller or larger number of connections between the "backplane" element and the heat pump modules is possible to support whatever circumstances are involved. Such additional connections may be for controls (if not integrated into the electrical connector (120)), vacuum, emergency overpressure gaseous release to a safe area, clutched mechanical drive, etc.

Figure 2:
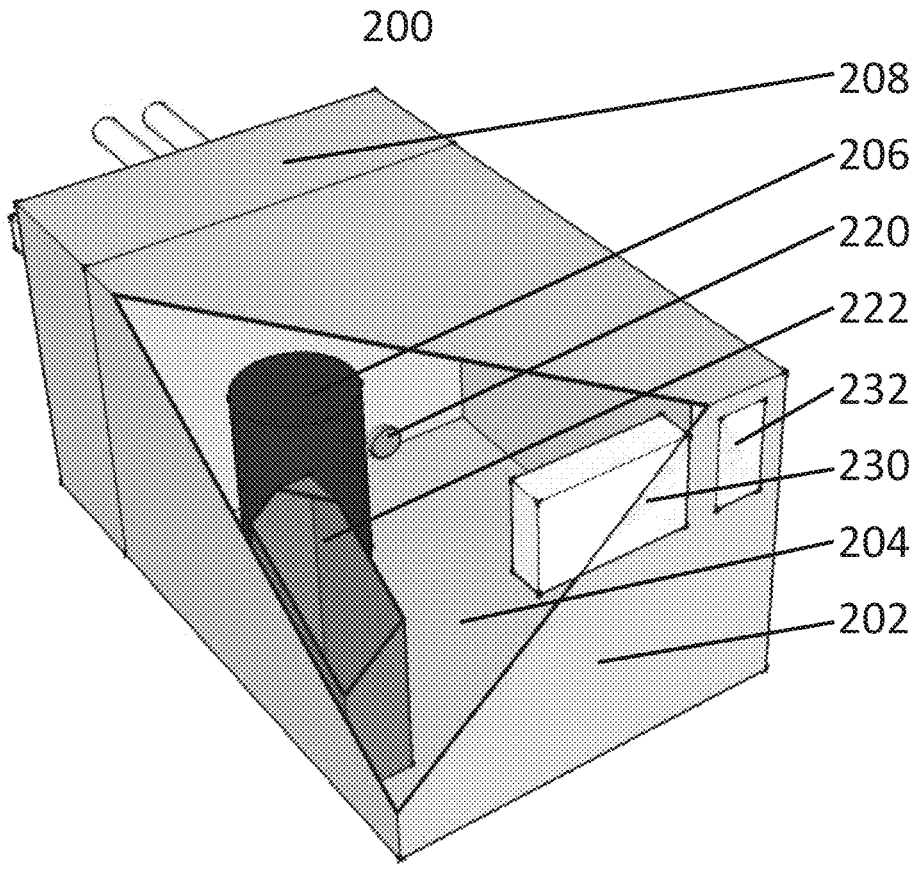
FIG. 2 shows a break-away depiction of a removable heat pump module.

FIG. 2 shows a break-away depiction of a removable heat pump module (200) with an outer frame (202) being in this case also a hermetic enclosure creating an encapsulated space (204) to fully contain any refrigerant leak. The compressor (206) and all refrigerant piping, valves, dryer, etc. (all common refrigeration system components and not shown for simplicity) are completely within the enclosed space (204) such that any leakage is contained. The thermal exchange in this case is via a double-wall set of heat exchangers (208) which have their inter-wall area connected back (220) to the enclosed space (204) such that any single wall leak even in the heat exchangers is fully contained. With maintenance of vacuum in the enclosed space, outer single wall leakage will also be detectable by loss of vacuum. The same is true for other types of double wall exchangers not shown here, such as for hot plates and remote exchangers including air coils, provided their outer wall is carried back to the enclosed space (204) for full containment. Also shown are areas for electrical (230) and enclosed space testing ports (232), where those spaces are double sealed with outer enclosures when not being serviced.

Figure 3:
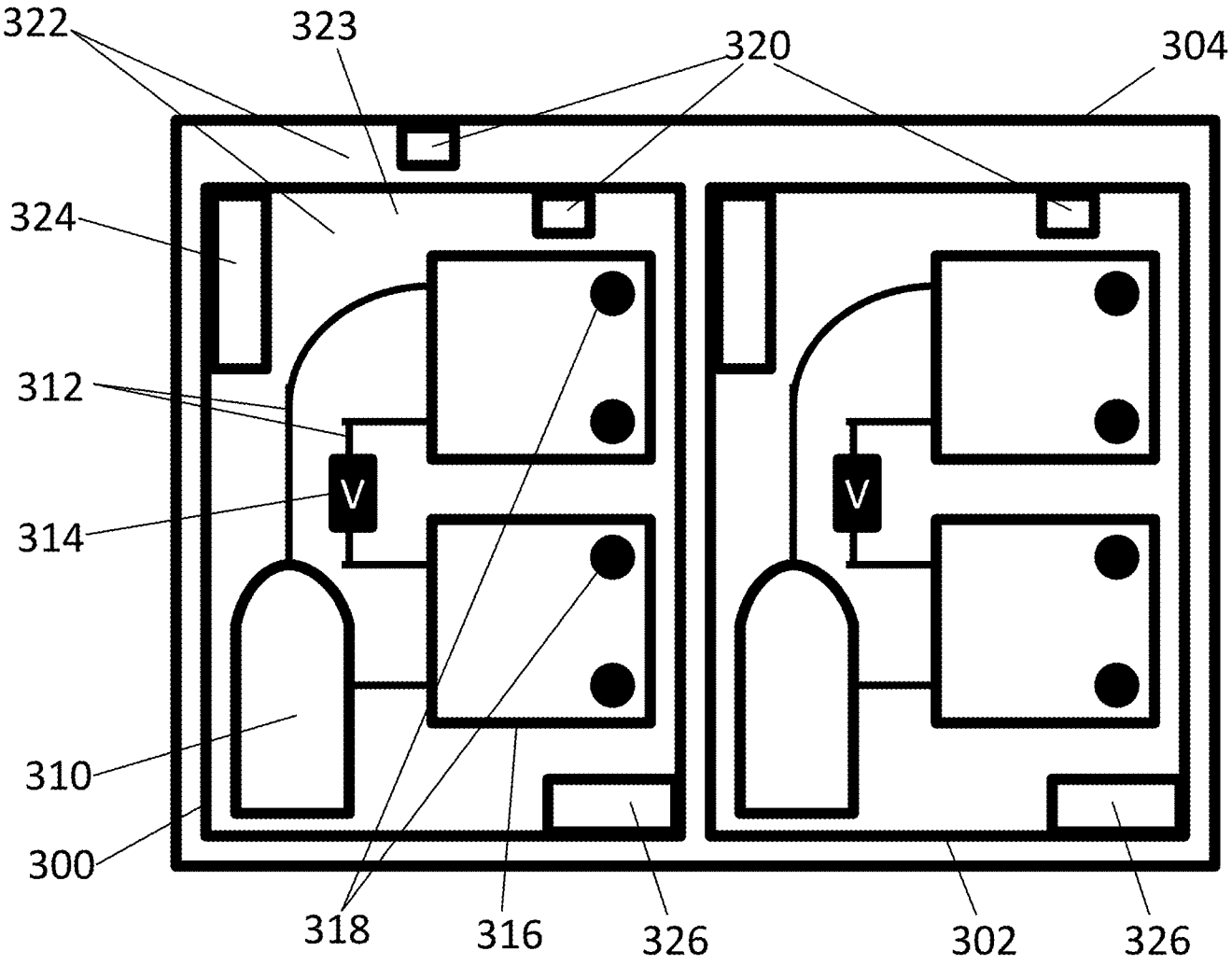
FIG. 3 shows a schematic depiction of one embodiment removable heat pump module apparatus.

FIG. 3 shows a schematic depiction of one embodiment removable heat pump module apparatus, here showing two encapsulated heat pump modules (300, 302) optionally further encapsulated within another encapsulation (304) where extreme safety is required (304) producing encapsulated areas (322) which may be optionally maintained at a vacuum, where within the heat pump modules there are a compressor (310), refrigerant tubing (312), a refrigerant regulation valve (314), and pressure sensors (320) to ensure containment via a digital controller (326) which may be in an externally accessible part of the core heat pump module (300, 302) to allow the circuit board to be serviced and replaced without needing to either remove the heat pump module or break into the inner encapsulated area (323). In this depiction, the external thermal interface is via double wall refrigerant to water heat exchangers (316) which protrude through the outer enclosure with water lines (318). An energy absorber (324) is shown as one possible method for providing even further safety than using refrigerants capable of any over pressure event, said absorber being for example a sealed honeycomb structure which would collapse on high pressure.

Figure 4:
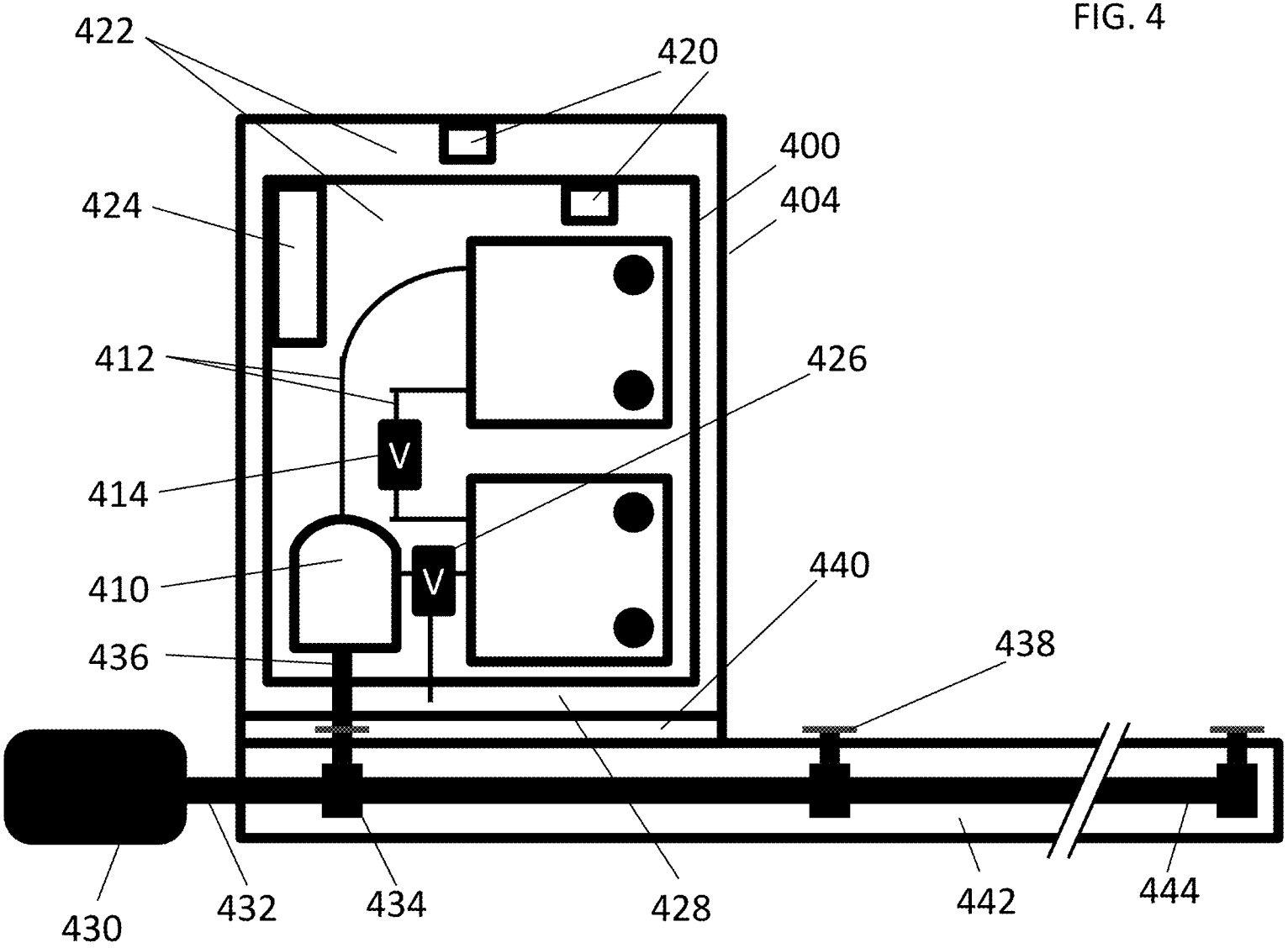
FIG. 4 shows another embodiment of a thermal system apparatus employing removable heat pump modules in volume with centralized mechanical power.

FIG. 4 shows another embodiment of a thermal system apparatus employing removable heat pump modules in volume with centralized mechanical power, where the Encapsulated Heat Pump Module (400) optionally further encapsulated within another encapsulation (404) where extreme safety is required producing encapsulated areas (422) which may be optionally maintained at a vacuum, where within the heat pump modules there are a compressor (410), refrigerant tubing (412), a refrigerant regulation valve (414), and pressure sensors (420) to confirm containment. In this depiction, the compressor is powered centrally (430) such as with a three phase motor and a drive shaft (432) for two or more heat pump modules, where the power for each individual module is taken off with a gearbox (434) a shaft (436) and a clutch/coupling device (438). Since this configuration may lead to micro refrigerant leakage at the shaft seals, a secondary vacuum area (440) is maintained, the whole drive shaft area is maintained at vacuum (442), and auto refrigerant recovery from within an outer and/or inner encapsulated area is provided for with a refrigerant recovery valve (426) capable of letting the compressor low side connect only to the enclosure area for a brief period of time. Further module connections locations are shown (444) An energy absorber (424) is shown as one possible method for providing even further safety then using refrigerants capable of any over pressure event, said absorber being for example a sealed honeycomb structure which would collapse on high pressure.

Figure 5:
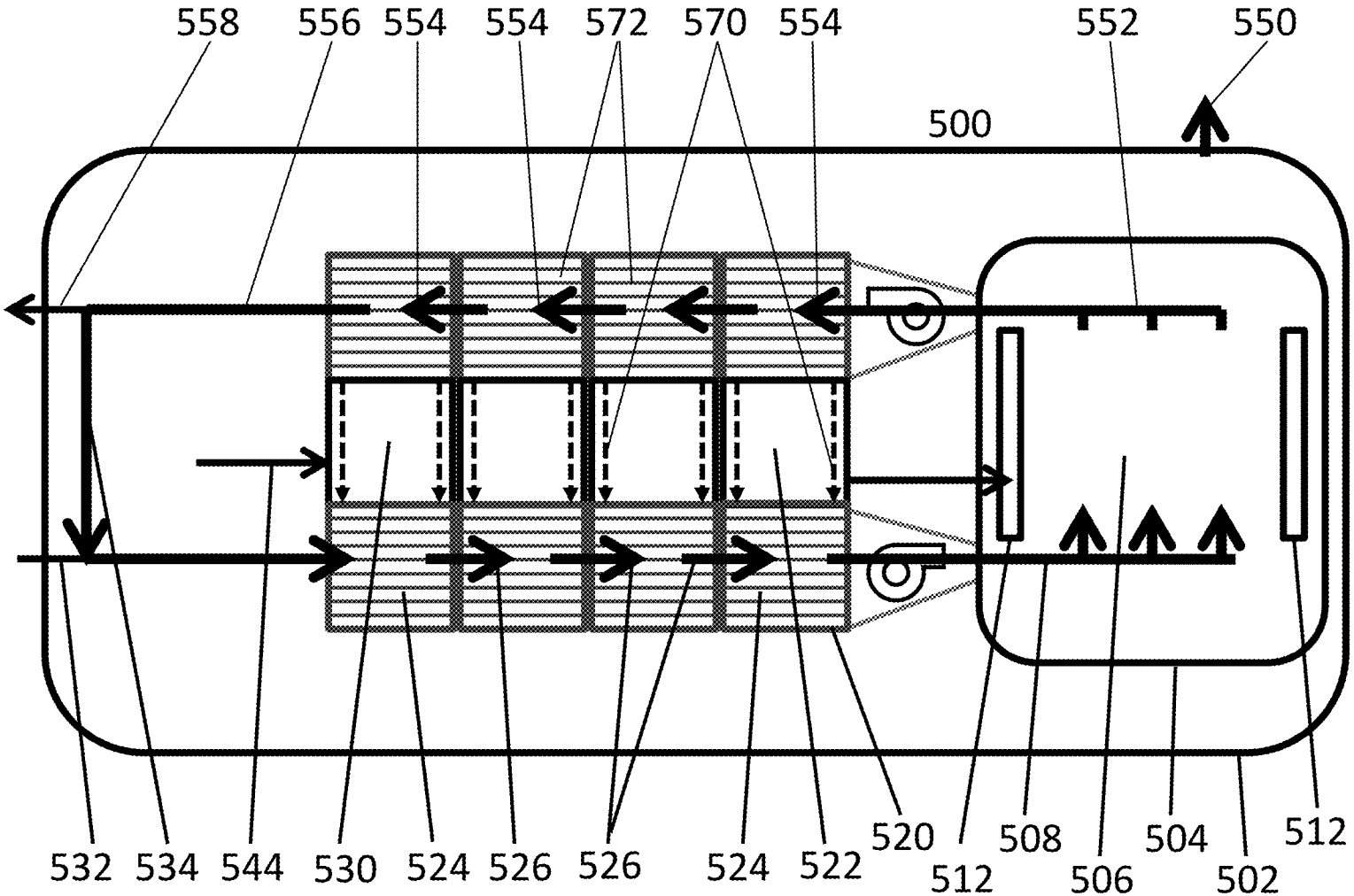
FIG. 5 shows one embodiment of a thermal system apparatus employing removable heat pump modules in volume to provide an industrial thermal process involving drying and/or direct heating in overview.

FIG. 5 shows one embodiment of a thermal system apparatus employing removable heat pump modules in volume to provide an industrial thermal process involving drying and direct heating in overview, where the total thermal system (500) is contained within an outer thermal enclosure (502) to significantly limit the net energy loss (550), where the industrial "process" happens within an "oven" or other enclosure (504) with product passing through the inner space (506) where where hot air is needed (508) it is supplied from the final stage (522) of a multi-stage heat pump module thermal system (520) which produced an increasingly hot air flow (526) flowing from earlier stages and the first stage (530) which takes in ambient air (532) and prior exhausted air (534) that has been cooled and dehumidified already to extract its energy for return to the process via the increasingly hot air flow (526). As shown here, the generally hotter modules (522) and the generally cooler modules (530) will typically have different refrigerants to provide maximum efficiency. When needed, direct heating plates (512) are provided which are driven by a high temperature refrigerant loop. Electricity to drive the heat pump modules (544) is supplied to the multi-stage heat pump module thermal system (520). On the other side of the system, hot wet air (552) is taken out of the process enclosure (504) into the multi-stage heat pump module thermal system (520), first to the final stage (522) and then subsequent stages producing an ever cooler air flow (554) which finally leaves the first stage (530) as roughly ambient air (556) which may be partially exhausted (558) and otherwise returned to the process (534) and reheated. The flow of thermal energy within the heat pump modules is depicted in general by small dashed arrows in each heat pump module (570) from the cooling air coils (572) to the heating air coils (524).

Figure 6:
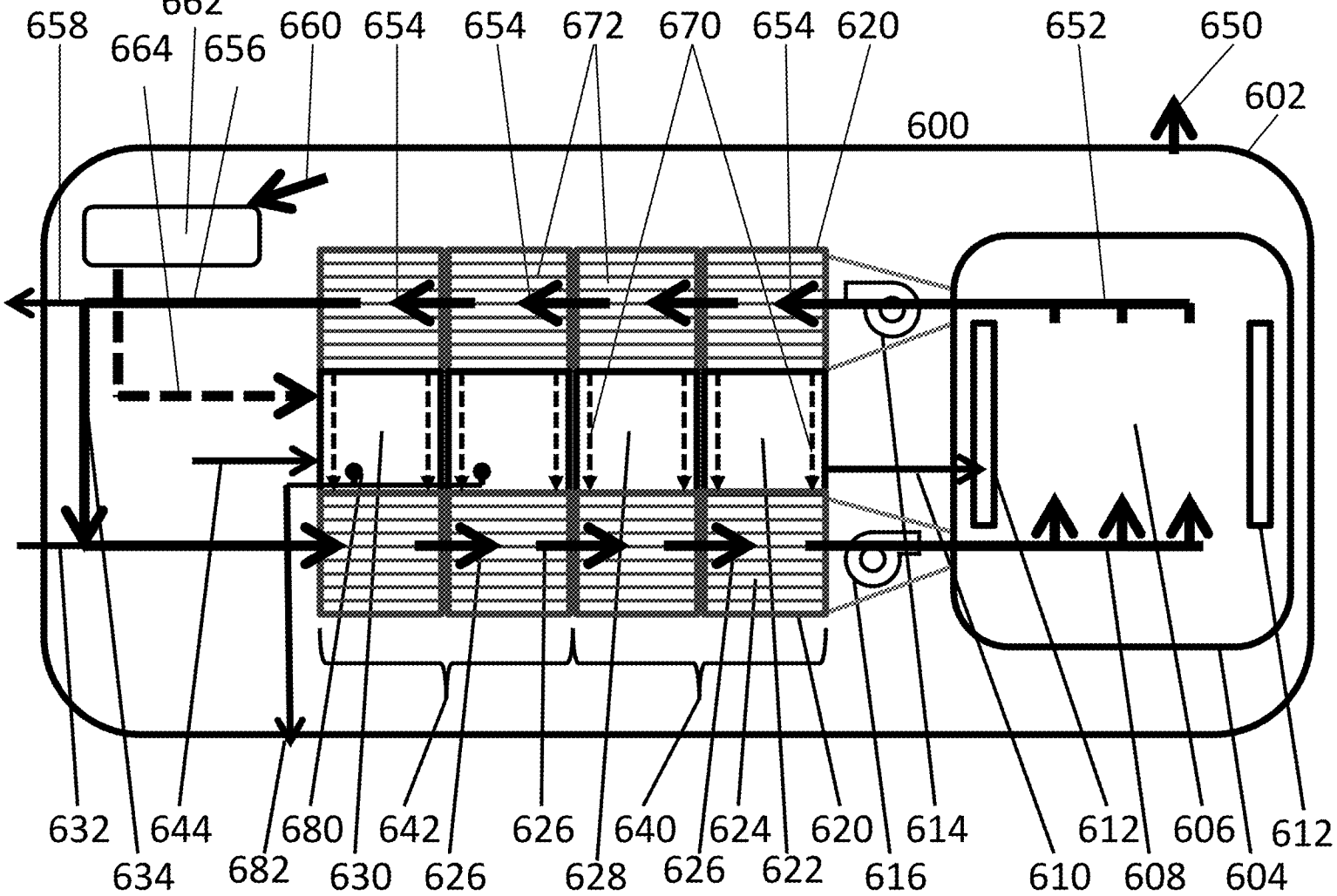
FIG. 6 shows one embodiment of a thermal system apparatus employing removable heat pump modules in volume to provide an industrial thermal process involving drying and/or direct heating in greater detail.

FIG. 6 shows one embodiment of a thermal system apparatus employing removable heat pump modules in volume to provide an industrial thermal process involving drying and direct heating in greater detail, where the total thermal system (600) is contained within an outer thermal enclosure (602) to significantly limit the net energy loss (650), where the industrial "process" happens within an "oven" or other enclosure (604) with product passing through the inner space (606) where hot air is needed (608) it is supplied by a fan (616) coming from the final stage (622) of a multi-stage heat pump module thermal system (620) which for a hot air delivery has refrigerant to air exchangers (624) producing an increasingly hotter air flow (626) flowing from earlier stages (628), with the first stage (630) taking in ambient air (632) and prior exhausted air (634) that has been cooled and dehumidified already to extract its energy for return to the process via the increasingly hot air flow (626). As shown here, the generally hotter modules (640) and the generally cooler modules (642) will typically have different refrigerants to provide maximum efficiency. When needed, direct heating plates (612) are provided which are driven by a high temperature refrigerant loop (610). Electricity to drive the heat pump modules (644) is supplied to the multi-stage heat pump module thermal system (620), and condensation is extracted (680) and drained from the system (682) as needed. On the other side of the system, hot wet air (652) is taken out of the process enclosure (604) by the exhaust fan (614) into the multi-stage heat pump module thermal system (620), first to the final stage (622) and then subsequent stages producing an ever cooler air flow (654) which finally leaves the first stage (630) as roughly ambient air (656) which may be partially exhausted (658) and otherwise returned to the process (634) and reheated. In the process of cooling, condensation occurs (680). To capture as much of the energy as practical, energy is recovered (660) from the outer thermal enclosure (602) via an energy recovery system such as a fan coil (662) and that energy is returned (664) to the first stage heat pump module (630). The flow of thermal energy within the heat pump modules is depicted in general by small dashed arrows in each heat pump module (670) from, in this case, the cooling air coils (672) to the heating air coils (624). With the first stage, energy is also added from the fan coil (662).

Figure 7:
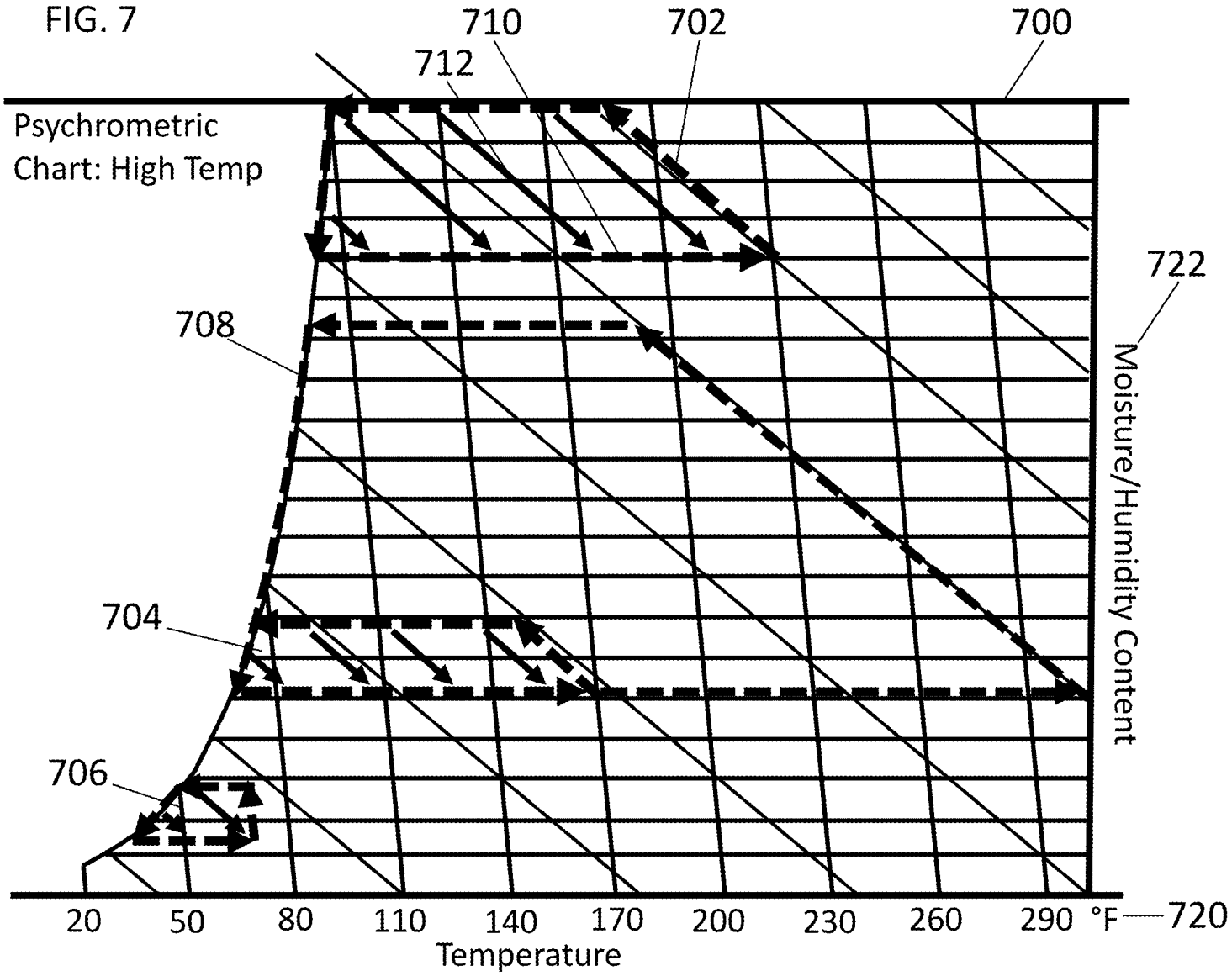
FIG. 7 shows one example psychrometric chart workup of the air drying aspect of a multi-stage thermal system apparatus employing removable heat pump modules.

FIG. 7 shows four example psychrometric chart workups of a multi-stage thermal system apparatus employing removable heat pump modules, where the psychrometric chart (700) is used to outline a high temperature drying process (702), a mid temperature drying process such as for pulp (704), a low temperature drying process such as for laboratory ventilation energy recovery (706), and one possible cooking energy recovery (708), where each workup shows in broken arrowed lines the thermal or humidity changes (710) for each individual heat pump module (712) involved. It is entirely possible that more stages will be used for any particular process with that decision being an economics tradeoff based on equipment cost and operational expense, with the smaller the step in the thermal direction (x-axis 720) and humidity direction (722) being more cost effective.

Figure 8:
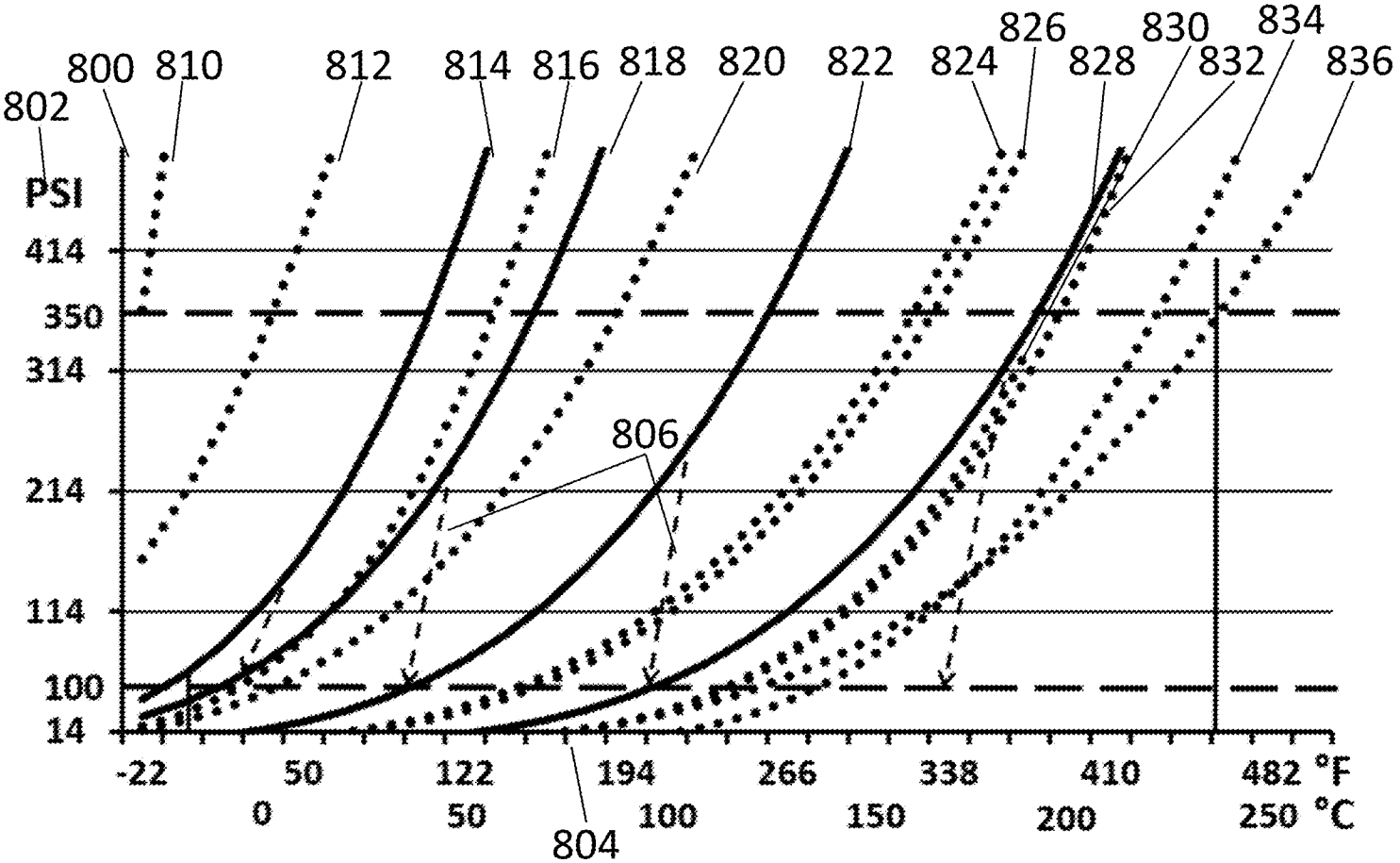
FIG. 8 is graphic showing the temperature pressure curves of specific identified refrigerants through 550° F./240° C.

FIG. 8 is a graphic showing the temperature pressure curves of specific identified refrigerants through about 550° F./240° C., wherein the graph (800) has a vertical scale for pressure (PSI) (802) and a horizontal scale for temperature (804), and shows the following select group of refrigerant vapor point curves being a representative sample capable of being used in a step-wise manner (806) to achieve any temperature from the freezing point of water to the boiling point of mercury at about 350 psi: CO2 (810), Ethane (812)

Difluoromethane (814), Ammonia (816), Propane (818), Dichlorodifluoromethane (820), Butane (822), Chlorofluoromethane (824), Methylbutane/Isopentane (826), Acetone (828), Ethanol (830), Isopropyl alcohol (832), Water (834), and Carbon tetrachloride (836).

Figure 9:
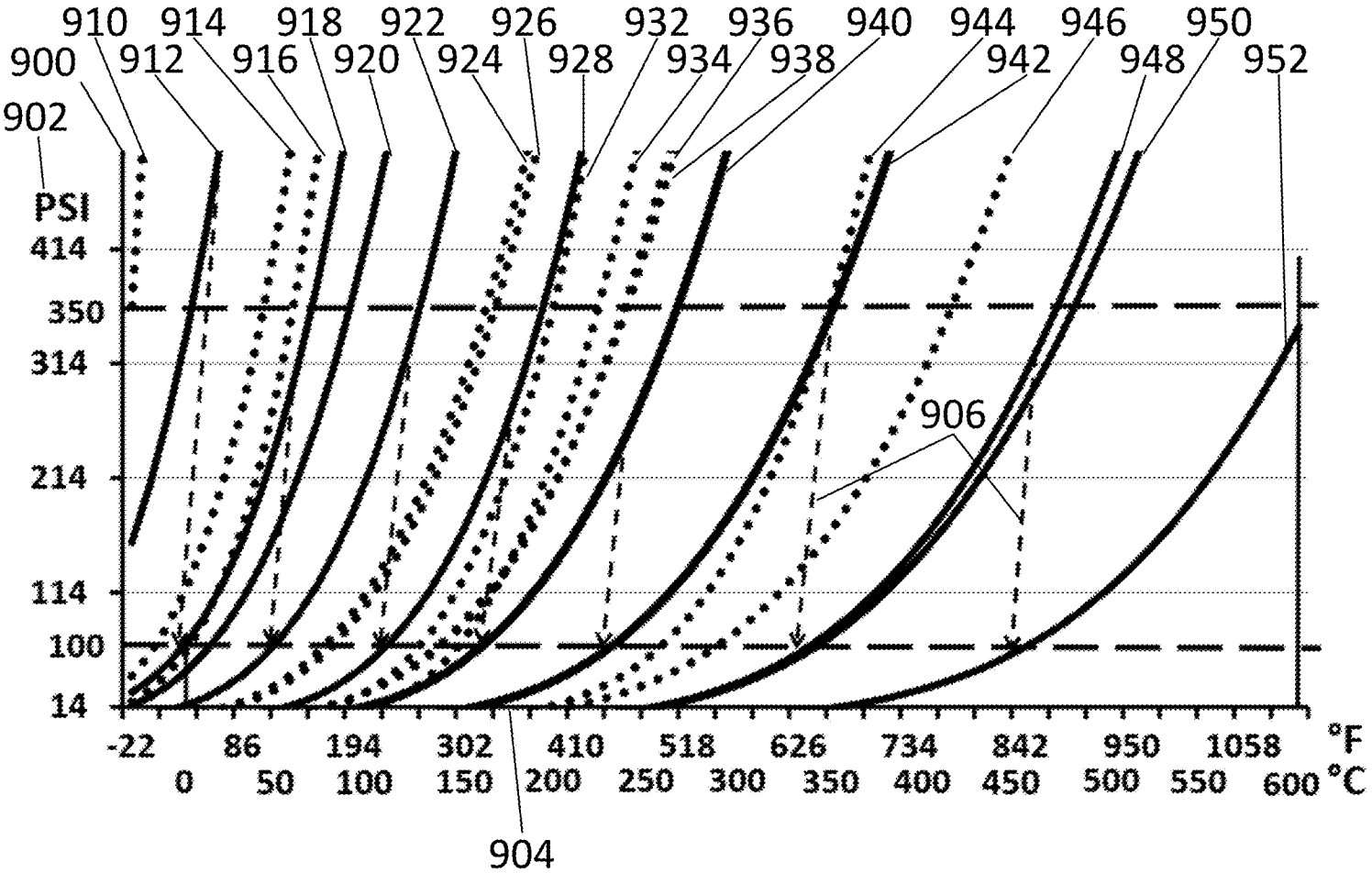
FIG. 9 is graphic showing the temperature pressure curves of specific identified refrigerants through 1100° F./550° C.

FIG. 9 is a graphic showing the temperature pressure curves of specific identified refrigerants through approximately 1100° F./550° C., wherein the graph (900) has a vertical scale for pressure (PSI) (902) and a horizontal scale for temperature (904), and shows the following select group of refrigerant vapor point curves being a representative sample capable of being used in a step-wise manner (906) to achieve any temperature from the freezing point of water to the boiling point of mercury at about 350 psi: CO2 (910), Ethane (912) Difluoromethane (914), Ammonia (916), Propane (918), Dichlorodifluoromethane (920), Butane (922), Chlorofluoromethane (924), Methylbutane/Isopentane (926), Acetone (928), Isopropyl alcohol (932), Water (934), Benzene (936), Carbon tetrachloride (938), Heptane (940), Propylbenzene (942), Ethylene Glycol (944), Nitrobenzene (946), Biphenyl (948), Diphenyl Ether (950), and Mercury (952).

Figure 10:
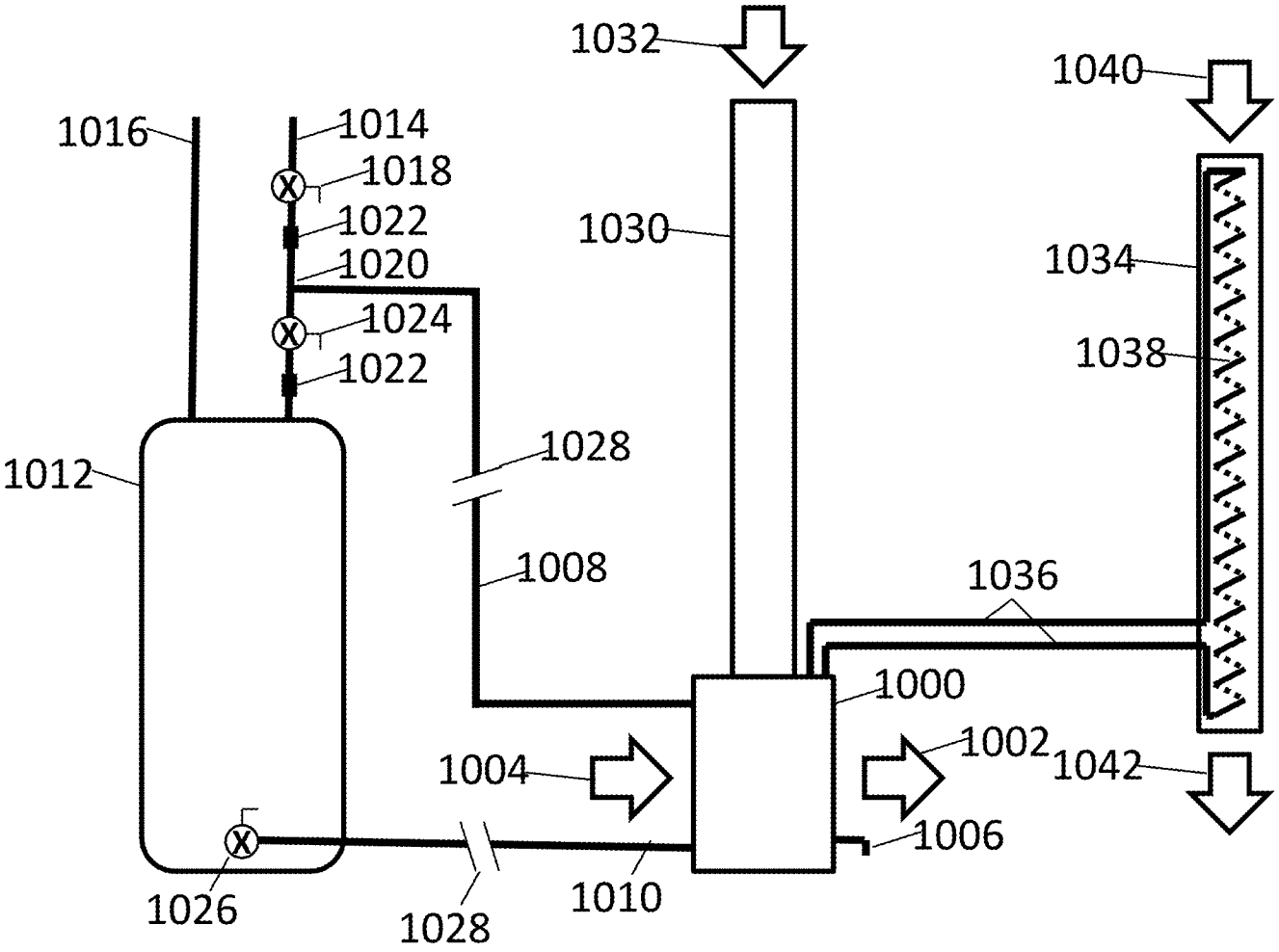
FIG. 10 is a depiction of one embodiment of a modular encapsulated heat pump module being applied for extremely efficient combined dehumidification and hot water heating.

FIG. 10 is a depiction of one embodiment of a modular encapsulated heat pump module being applied for extremely efficient combined dehumidification and hot water heating, wherein the modular encapsulated heat pump module (1000) is connected via pipes or hoses (1008 & 1010) to the hot water tank (1012) with a cold water line in (1014) and hot water line out (1016), said connection being made via valved connections (1026 & 1024) where an easy retrofit kit includes the valves and tee connection (1020) and couplings (1022) to the cold water inlet line (1014) and tank drain (1026) and where the modular encapsulated heat pump module (1000) may be remote (1028) from the tank (1012) to allow positioning at the best location for dehumidification and noise, and where connection is made after turning off the water flow (1018). The air flow for dehumidification is indicated both in (1004) and out (1002), and an alternative simple vertical duct is shown (1032) to allow input of the warmer air at the top of the room instead of from the floor (1004), and where another thermal source is shown for when dehumidification is not needed being a draft column (1034) containing a pipe coil (1038) connected to the Encapsulated Heat Pump Module (1000) via pipes (1036) which can be simple insulated pex piping for easy installation of a remote draft column if the loop uses water (one configuration) or can be standard small copper refrigerant tubing when the draft column is instead a refrigerant loop.

Figure 11:
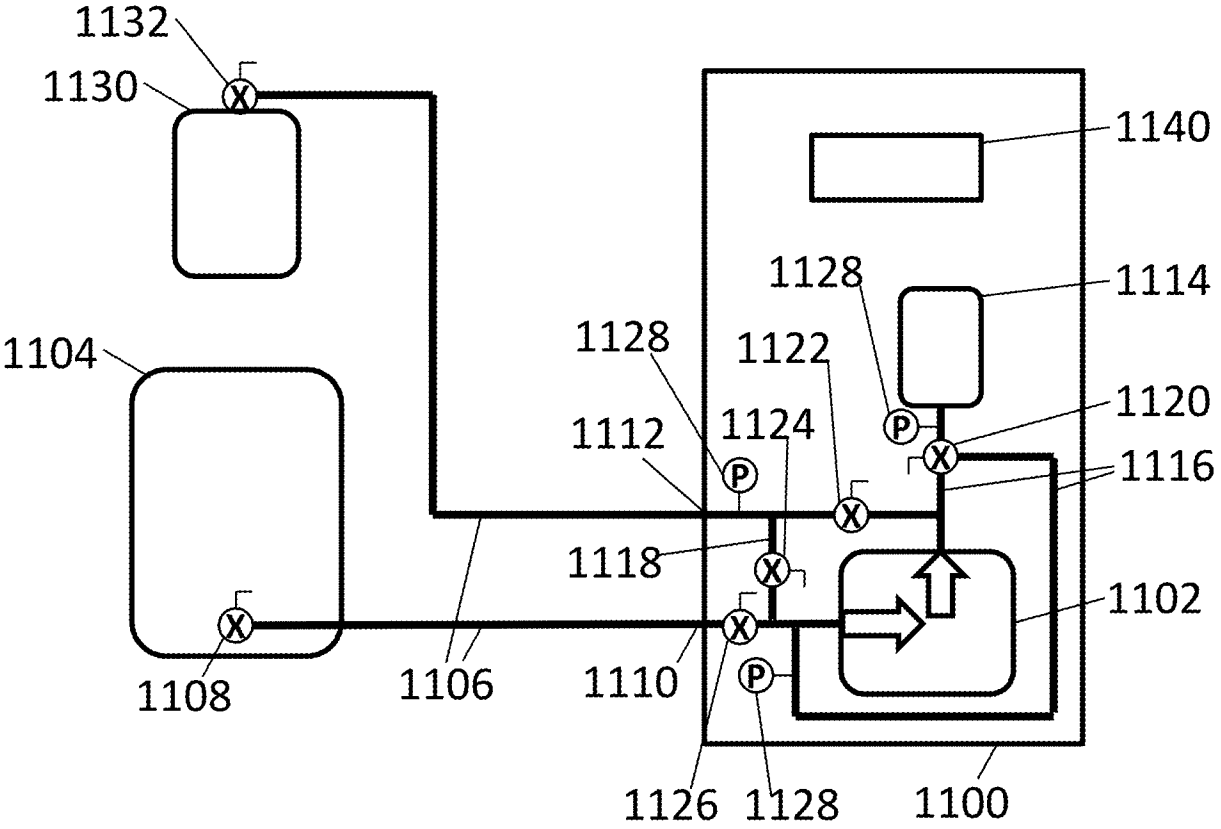
FIG. 11 is graphic depiction of the Zero Leak Refrigerant Servicing Tool.

FIG. 11 is a graphic depiction of the Zero Leak Refrigerant Servicing Tool (1100) containing a typical refrigerant reclamation pump with direction of pump flow shown by arrows inside the pump (1102) connected to the refrigerant system being serviced (1104) and refrigerant reclamation tank when needed (1130) via hoses (1106) connected at the system being serviced at port(s) (1108) and reclamation tank port(s) (1132) also shown here with manual Schrader Valve actuators depicted as valves, with the same hoses (1106) connected to the Zero Leak Refrigerant Servicing Tool (1100) at an input refrigerant connection port (1110) and an output refrigerant connection port (1112), where a refrigerant holding tank (1114) is included to capture any refrigerant remaining in the hoses before they are disconnected, various piping is included including new pipes (1116) for alternatively connecting the holding tank (1114) to either the input or output of the reclamation pump (1102), a new output to input connection port cross pipe (1118), a set of valves (1120, 1122, 1124, 1126, with valve 1120 here shown as a 3-way valve) capable of alternatively connecting the refrigerant storage tank (1114) to either the refrigerant reclamation pump input or output and capable of connecting the hoses alternatively to either only the reclamation pump input or to both the reclamation pump input and output, and a set of pressure sensors (1128) labeled "P" and a computerized controller with user input and output (1140) for automated control and reporting when desired. The same equipment and techniques can be used for zero refrigerant leakage when performing any refrigerant equipment servicing when the input port (1110) is connected to the system being serviced (typically via a gauge set, not shown), the output port (1112) being simply capped, and the same after-reclamation process followed for eliminating any refrigerant from the hoses (1106) by storing it in the internal refrigerant holding tank (1114). While the encapsulated heat pump modules provide for zero refrigerant leakage, some refrigerant leakage will always occur without the Zero Leak Refrigerant Servicing Tool. It is an essential companion tool to enable zero leakage servicing of these heat pumps which is very important when they are charged with high temperature flammable refrigerants.

What is claimed is:

1. Apparatus being a removable heat pump module for safely utilizing explosive and toxic refrigerants within a thermal system, said apparatus comprising:

a heat pump element;

a connectivity set;

an encapsulating enclosure; and a space occupying energy absorbing element, where the thermal system is any system for delivery of thermal energy regardless of thermal polarity;

the heat pump element contains at least a compressor, one or more regulating valves, a refrigerant dryer, associated refrigerant tubing, a set of thermal sensors, a computerized controller, and a set of refrigerant test ports for servicing;

the connectivity set includes an electric supply connection and a controls connection, and includes at least one of a) a thermally affected air flow, b) a thermal transfer fluid flow, c) a refrigerant flow, and d) a direct thermal energy flow;

the connectivity set may include a) a motor and refrigerant oil cooling fluid flow, b) a desuperheater fluid flow, c) a vacuum flow, e) a mechanical drive interface, and f) a safety vent flow;

the encapsulating enclosure contains and supports all the elements of the heat pump module and of the connectivity set, and enables removal and installation of the heat pump module from the thermal system, will contain any potential leakage of refrigerant from the heat pump element, and can be opened for servicing;

the connectivity set and the heat pump element are configured such that no refrigerant leakage will occur during the removal and installation of the heat pump module from the thermal system provided that a zero leakage refrigerant system servicing tool is used; and the space occupying energy absorbing element occupies space within the encapsulating enclosure, is removable from the heat pump element when servicing is needed, and will absorb extreme pressure to maintain integrity of the encapsulating enclosure during a refrigerant leak and any overpressure byproduct of that leak including any refrigerant combustion event.

2. The apparatus of claim 1 wherein said heat pump module serves at least one of:

a heating mode, a cooling mode, and a heating and cooling mode with the current mode selected by the computerized controller controlling the reversing valve which must be installed.

3. The apparatus of claim 1 wherein the heat pump module can be isolated from and removed from the thermal system while the remainder of the thermal system remains in continuous operation.

4. The apparatus of claim 1 wherein said connectivity set includes plugs for the electric supply and controls connections; at least one ducted area for the air flow;

a pair of pipe connectors for each utilized of a) the thermal transfer fluid flow, b) the refrigerant flow, c) the motor and refrigerant oil cooling fluid flow, and d) the desuperheater fluid flow; and a valved single pipe for each utilized of the vacuum flow and safety vent flow.

5. The apparatus of claim 4 wherein said pipe connectors are capable of mating with matching pipe connection elements that are present in the thermal system.

6. The apparatus of claim 3 wherein said pipe connectors contain valves capable of sealing in all refrigerants and fluids while the module is not operationally integrated into the thermal system.

7. The apparatus of claim 1 wherein said connectivity set further includes a safety vent pipe connector with a blowout plug for emergency overpressure gaseous release to a safe area such as the outdoors.

8. The apparatus of claim 1 wherein said connectivity set includes a clutched mechanical drive coupling with a shaft penetrating the encapsulating enclosure and multi-layer containment capable of providing common shaft driven motive force for the compressor while ensuring no leakage of refrigerant.

9. The apparatus of claim 1 wherein the space occupying energy absorbing element is one or more separate such elements which can both occupy the space within the encapsulating enclosure and can still be removed for free access to the heat pump element when servicing the heat pump element and reinstalled after servicing.

10. The apparatus of claim 1 wherein the encapsulating enclosure includes a refrigerant recovery pump connected to the heat pump element for recovering any refrigerant leaked inside the encapsulating enclosure under normal operation.

11. The apparatus of claim 9 wherein said connectivity set further includes a vacuum flow pipe connector for maintaining vacuum environment where needed to protect the hermetically enclosed area inside the hermetic enclosure.

12. The apparatus of claim 9 wherein double-wall refrigerant coils with their inter-wall area connected to the hermetically enclosed area to fully contain any refrigerant leak.

13. The apparatus of claim 9 wherein the pipe connectors for any external refrigerant flow involve a double wall pipe connector and double wall piping with the inter-wall area connected to the hermetically enclosed area of the removable heat pump module to fully contain any single-wall refrigerant leak even outside the hermetic enclosure.

14. Apparatus being a thermal system utilizing removable heat pump modules with encapsulating enclosures using explosive and toxic refrigerants, said apparatus comprising:

a connectivity set for each of the heat pump modules;

a computerized controller; and a space occupying energy absorbing element where the thermal system is any system for delivery of thermal energy regardless of thermal polarity;

the thermal system enables removal of any heat pump module without overall system shutdown for rapid and uncomplicated serviceability while maintaining continuous operation;

the connectivity set includes an electric supply connection and a controls connection, and at least one element selected from the group consisting of a thermally affected air flow, a thermal transfer fluid flow, a refrigerant flow, and a direct thermal energy flow, a motor and refrigerant oil cooling fluid flow, a desuperheater fluid flow, a vacuum flow, a clutched mechanical drive coupling, and a safety vent flow; and the heat pump modules in encapsulating enclosures each contain at least a compressor, one or more regulating valves, a refrigerant dryer, associated refrigerant tubing, a set of thermal sensors, a computerized controller, a set of refrigerant test ports for servicing, and a set of heat pump module to thermal system connections matching the connectivity set;

the computerized controller controls overall thermal system operation while also enabling removal and installation of any one of the heat pump modules while the thermal system remains in operation;

the space occupying energy absorbing element is removable from the heat pump modules when servicing is needed, and will absorb extreme pressure to maintain integrity of the encapsulating enclosures during a refrigerant leak and any overpressure byproduct of that leak including any refrigerant combustion event; and the connectivity set and the removable heat pump modules are configured such that no refrigerant leakage will occur during the removal and installation of the heat pump modules from the thermal system provided that a zero leakage refrigerant system servicing tool is used.

15. The apparatus of claim 14 wherein said connectivity set includes connectors for the electric supply and controls connections; a pair of valved pipes for each utilized of the thermal transfer fluid flow, the refrigerant flow, the motor and refrigerant oil cooling fluid flow, and the desuperheater fluid flow; and a valved single pipe for each utilized of the vacuum flow and safety vent flow.

16. The apparatus of claim 14 wherein said pipe connectors are capable of mating with matching pipe connection elements that are present in the heat pump modules without leakage.

17. The apparatus of claim 14 wherein said pair of valved pipes for the refrigerant flow includes additional valves to facilitate refrigerant reclamation from and vacuum for those pipes to enable proper disconnection and reconnection.

18. The apparatus of claim 14 wherein when said connectivity set includes a clutched mechanical drive coupling for providing motive force for the compressor inside the heat pump modules and those heat pump modules are encapsulated and contain a vacuum in their encapsulated inner space, that also provided is a sealing vacuum enclosure at the mechanical drive coupling location such that a vacuum can be reliably maintained on the outside of any mechanical linkage shaft seal.

19. The apparatus of claim 14 wherein when said thermal system utilizing removable heat pump modules is a multi-staged dual ducted industrial drying and cooking system with an out flow and in flow of air where energy is recovered from the outgoing air flow and inserted into the incoming air flow at each stage for maximum efficiency.

20. Apparatus being a zero leakage refrigerant system servicing tool for zero leakage servicing of explosive and toxic refrigerant systems, said apparatus comprising:

an input refrigerant connection port;
an output refrigerant connection port;
a refrigerant reclamation pump;
a refrigerant holding tank;
a set of valves; and
a set of hoses with manual spring loaded valve actuators,
where the input and output refrigerant connection ports and the refrigerant reclamation pump are as one would typically use for evacuating refrigerant from a vapor cycle refrigeration system but are here embedded with the rest of the elements except the hoses;
during reclamation, the set of valves connects the reclamation pump output to the output refrigerant connection port and the reclamation pump input to both the input refrigerant connection port and the refrigerant holding tank, the hoses are connected to the refrigerant system being serviced, manual spring loaded valve actuators on the hoses are positioned in their open mode, and the reclamation pump is operated; and
following reclamation, the manual spring loaded valve actuators on the hoses are closed, the set of valves isolates the output refrigerant connection port then connects the output of the reclamation pump to the refrigerant holding tank and the input of the reclamation pump to both the output refrigerant connection port and the input refrigerant connection port, the reclamation pump is operated while monitoring the pressure sensors to assure evacuation of all lines, the set of valves isolates the refrigerant holding tank, and the hoses are disconnected from the refrigerant system being serviced.

21. The apparatus of claim 20 wherein when said zero leakage refrigerant system servicing apparatus is utilized without refrigerant reclamation and only to assure evacuation of the refrigerant lines by connecting only the input refrigerant connection port to a normal gauge set at any point, the manual spring loaded valve actuators on the hoses are closed, the set of valves isolates the output refrigerant connection port then connects the output of the reclamation pump to the refrigerant holding tank and the input of the reclamation pump to both the output refrigerant connection port and the input refrigerant connection port, the reclamation pump is operated while monitoring the pressure sensors to assure evacuation of all lines, the set of valves isolates the refrigerant holding tank, and the hoses are disconnected from the refrigerant system being serviced.

22. The apparatus of claim 20 wherein when said zero leakage refrigerant system servicing apparatus includes:
a computerized controller with a user input and a user output;
a set of digital pressure sensors;
a motor controller; and
a set of motorized valve actuators,
where both the reclamation pump is controlled by the computerized controller via the motor controller;
the set of valves are controlled by the computerized controller via the set of motorized valve actuators;
the digital pressure sensors are connected to each isolatable area of the refrigerant piping;
the controller monitors the set of digital pressure sensors;
the controller engages the reclamation pump only when a proper pressure situation is present and the user requests such operation via the user input; and
the controller reports the current status to the user via the user output.

* * * * *